US005454177A

United States Patent [19]

Dutournier

[11] Patent Number: 5,454,177

[45] Date of Patent: Oct. 3, 1995

[54] PROCESS FOR THE TREATMENT OF OBJECTS WITH AN INFLAMMABLE VOLATILE LIQUID

[75] Inventor: Bertrand Dutournier, Viroflay, France

[73] Assignee: L'Air Liquide, Societe Anonyme pour l'Etude et l'Exploitation des Procedes Georges Claude, Paris, France

[21] Appl. No.: 198,089

[22] Filed: Feb. 17, 1994

[30] Foreign Application Priority Data

Feb. 23, 1993 [FR] France ..... 93 02038

[51] Int. Cl.[6] ..... F26B 21/10

[52] U.S. Cl. ..... 34/470; 34/471; 34/74; 34/78; 34/516; 134/21

[58] Field of Search ..... 34/73, 77, 419, 34/427, 493, 494, 37, 74, 78, 470, 471, 516, 517; 134/18, 21, 30, 37, 95.2, 108, 111; 239/6, 34

[56] References Cited

U.S. PATENT DOCUMENTS

| | | | |
|---|---|---|---|
| 3,798,787 | 3/1974 | Heen | 34/77 |
| 4,150,494 | 4/1979 | Rothchild | 34/77 |
| 4,240,453 | 12/1980 | Vial et al. | 34/77 |
| 4,411,075 | 10/1983 | Blaudszun | 34/77 |
| 4,475,293 | 10/1984 | Banerjee | 34/77 |
| 5,156,173 | 10/1992 | Keyser et al. | 34/77 |
| 5,241,976 | 9/1993 | Ikawa | 134/108 |

FOREIGN PATENT DOCUMENTS

| | | |
|---|---|---|
| 0381372 | 8/1990 | European Pat. Off. . |
| 0482890 | 4/1992 | European Pat. Off. . |
| 0496899 | 8/1992 | European Pat. Off. . |
| 423281 | 4/1911 | France . |
| 4016275 | 1/1992 | Japan . |
| 3229681 | 10/1992 | Japan . |

*Primary Examiner*—Joseph W. Drodge
*Assistant Examiner*—Kenneth M. Jones
*Attorney, Agent, or Firm*—Young & Thompson

[57] ABSTRACT

A process for the treatment of objects with an inflammable volatile liquid, in an installation comprising at least one upwardly open tank (16) adapted to be filled with the liquid, a drying device (20) adapted to remove contained treatment liquid from the treated objects, and a transport system adapted to bring an object to be treated above the tank, and to immerse it in the tank, to withdraw it, and to transfer it into the drying device, then to remove it. The tank and the drying device are disposed in a closed chamber (2, 4) containing an atmosphere comprised principally of a protective gas, with an oxygen content maintained sufficiently low that the ignition of the treatment liquid will be impossible. This chamber is separated from the exterior by at least one gas lock (1, 5) containing the same atmosphere. The object to be treated passes through the gas lock to enter the chamber and by the same or another gas lock to be removed. In the drying device (20), the objects are brought to a temperature higher than that at which the vapors of the treatment liquid would burn in the presence of air. In the drying device (20), the objects are heated by blowing (23) of preheated protective gas. The preheated protective gas is comprised at least in part by protective gas from the chamber, which has been impoverished in treatment product vapors by passage through a condenser (22) before having been preheated.

4 Claims, 2 Drawing Sheets

PROCESS FOR THE TREATMENT OF OBJECTS WITH AN INFLAMMABLE VOLATILE LIQUID

BACKGROUND OF THE INVENTION

1. Field of the Invention

The present invention relates to a process for the treatment of objects with an inflammable volatile liquid.

2. Decription of the Related Art

The industrial cleaning by immersion of objects to be treated in a solvent has been known for a long time. The advent of noninflammable solvents, such as halogenated hydrocarbons (particularly chlorofluorocarbons or CFC) has been considered for several decades as a very major progress because it overcomes the risk of fire or explosion. For ecological regions, unfortunately, these products are now prohibited, and it is necessary to return to older solvents, and to take other precautions to limit the risk of fire.

The present invention is directed toward the use of cleaning products of class "A3"which is to say products whose flash point is between 55° and 100° C.

In normal operation, the proximity of a hot point and a flame in the environment of a cleaning machine using these products gives rise to a serious risk of fire or deflagration.

In the presence of an accidental escape, the solvent dissipates outside the tank, exposing the environment of the machine to the same risks, even if the hot point or the flame is at a substantially greater distance from the machine. It is possible to place a tank containing the dangerous product within a closed chamber, and to establish in this chamber a nonoxidizing protective atmosphere, which is to say containing for example less than 5% oxygen. The treatment operations would take place within this chamber, and once they were completed, the dangerous liquid would be transferred to a separate closed receptacle.

The opening of the chamber, for withdrawing the treated products, could not be performed without precautions, because the protective atmosphere is charged with solvent vapors, whose mixture with ambient air could create dangerous conditions.

It is known to overcome such problems with a gas lock.

Another solution of this problem can consist in interposing, at the inlet and outlet of the chamber, a "condensation chamber", provided with a condenser maintained at a fairly low temperature to reduce the content of the solvent vapors in the atmosphere to a fairly low level to avoid any risk of combustion. The passage through the condensation chamber of the products leaving the chamber must be slow to permit the vaporization of at least the major part of the solvent which remains on the surface of the objects, and if desired of their support or a basket which serves to move them. The condensation chamber located at the outlet thus constitutes also a "drying chamber", forming a part of the enclosure.

On the other hand, the movement of the objects in the condensation chamber, at the inlet as at the outlet, should be fairly slow to avoid the appearance of eddies which could place the ambient air in contact with the gas charged with solvent vapors, either within the chamber or outside of it.

These various precautions require that the speeds of movement within the treatment installation are often very much less than those which can be achieved in a manufacturing or packaging station, which complicates considerably the design of these plants.

The drying, which is the principal component of the slowness, can be accelerated if the last treatment stage consists in a passage through a tank containing water, deionized if desired, or another noninflammable liquid, because the drying can then be executed by blowing hot air, outside the chamber with the protective atmosphere.

However, this solution cannot be used in all cases. Moreover, it increases the complexity of the treatment installation because the first treatment liquid must be separated from the second liquid formed by the water or a noninflammable liquid.

The applicant has moreover determined that among the solvents envisioned for the replacement of halogenated hydrocarbons, certain ones (such as CFC) are sensitive to the presence of water vapor in the surrounding atmosphere, and undergo changed effectiveness by this presence, particularly in the case of operation in a closed circuit.

SUMMARY AND OBJECTS OF THE INVENTION

The object of the invention is to provide a treatment process which, while of course ensuring protection against the risks of flame and environmental pollution and also being as simple as possible, permits limiting the concentration of water vapor in the atmosphere present above the solvent baths, and leads to the enjoyment of speeds of treatment permitting if desired the placement of the installation in series in an industrial plant, for example between a fabrication station and a packaging station.

Preferably, the process according to the invention should be adapted to a preexisting installation, provided for noninflammable treatment products without important or costly modifications.

To obtain these results, the invention proposes a process for the treatment of objects with an inflammable volatile liquid, in an installation comprising at least one upwardly open tank and adapted to be filled with said liquid, a drying device adapted to remove the treatment liquid from the treated objects, and a transportation system adapted to bring an object to be treated above the tank, immerse it in the tank, withdraw it therefrom, and transfer it into the drying device, then removing it, at least said tank and the drying device being disposed in a closed chamber containing an atmosphere principally of a protective gas, with an oxygen content maintained sufficiently low that burning of the treatment liquid will be impossible therein, this chamber being separated from the exterior by at least one gas lock containing the same atmosphere, the object to be treated passing necessarily through said gas lock to enter the chamber, and by the same or another gas lock to be removed, this process particularly providing that, in the drying installation, the objects are moved at a temperature higher than that at which the vapors of the treatment liquid would combust in the presence of air.

The fact that, profiting from the presence of the protective atmosphere, the objects are transported at a relatively high temperature, permits a very great acceleration of drying, particularly if the products are wet with a liquid of low volatility. The maximum drying temperature is to be designed as a function of the nature of the objects, which should not be damaged by this heating.

Preferably, in the drying installation, the objects are heated by blowing protective gas, preliminarily heated.

The use of the hot gas permits a maximum reduction of the drying time, and the use for this purpose of the protective gas reduces the problems of control of the composition of the protective atmosphere.

Preferably, the protective gas preliminarily heated is comprised by at least one part of protective gas from the chamber, and which has been reduced in vapors of the treatment product by passage through a condenser before having been heated.

The fact of using a protective gas which is recycled but reduced in vapors of the treatment liquid increases further the speed of evaporation of the liquid retained on the objects to be dried. Moreover, the consumption of protective gas is reduced. On the other hand, the content of the treatment liquid vapors of the atmosphere in the chamber is reduced by the presence of the condenser.

The chamber can be common to the drying device and to the tank or tanks. However, it is preferred that the treatment device be in a separate chamber, which can be separated from that of the tank or tanks by a gas lock, or more simply by a door.

Another component of the treatment speed of the objects passing through the installation is the temperature of the liquid which is in the tanks. It is known that raising the temperature increases the speed of action of the liquid, but increases also the risk of fire in case of accident. An effective control of the atmosphere of the chamber, or of a portion of the chamber which contains the tanks, is therefore an important factor to permit obtaining the optimum treatment speed compatible with the needs of safety.

Preferably, the oxygen content of the atmosphere in the chamber is continuously controlled, and this content is adjusted by the input of fresh protective gas, and the temperature of the treatment liquid in the tank or tanks is continuously maintained at a sufficiently high predetermined level for good efficiency of treatment, but sufficiently low to guarantee that the product vapor content of the atmosphere of the chamber will be at a level below a predetermined value.

The reason for this arrangement is as follows: there are available rapid analyzers of the oxygen content of the gas, but the same reliability and repetitiveness is not obtained with analyzers of solvent vapors. Moreover, these analyzers are each adapted to a particular solvent, and the use of an otherwise adapted analyzer can lead to catastrophes, so that any change of the treatment liquid requires changing the analyzer. The control of the vapor content by the temperature of the liquid is, on the contrary, reliable and easy to practice. It will be noted that it gives the maximum vapor content, which constitutes an additional safety factor.

Preferably, to maintain a condition of low agitation in the chamber, the protective gas is introduced thereinto by passage through porous plugs.

The existence in the chamber of a condition of low agitation has as its result a decrease in the treatment liquid vapor content in the upper portion of the chamber, because these vapors are of greater density than the gas which is the basis of the protective atmosphere: nitrogen or carbon dioxide in general. The concentration in the upper portion, where the openings for the passage of the products are located, is therefore less than that indicated by the temperature of the liquid in tanks.

In the chamber containing the drying device, or in the "drying" portion of a common chamber, the conditions imposed on the atmosphere are different. An agitation of this atmosphere is necessary for rapid drying, at least adjacent to the objects to be dried. This can be obtained by disposing in the vicinity of these objects nozzles for blowing "fresh" protective gas, which is to say with a low content of treatment liquid vapors because it comes directly from a production installation or else because it has been externally purified. Agitation can also result from the measures indicated above. The design of this portion of the installation is however facilitated by the absence of tanks maintained at the optimum treatment temperature, which can be relatively high. The content of the atmosphere in treatment liquid vapors can be maintained at a low level either with a sufficient flow rate of fresh protective gas, this flow being calculated from an evaluation of the quantity of liquid retained by the objects to be dried, or by the condenser mentioned above.

The provision, in the process according to the invention, of a protective atmosphere particularly in the chamber (such as an atmosphere based on nitrogen or carbon dioxide) also permits reducing substantially the residual concentration of water vapor present in the atmosphere above the baths (which otherwise under conventional operating conditions in air is likely dependent on the climatic conditions), rendering the process according to the invention completely compatible with all the solvents envisioned for the replacement of CFC.

BRIEF DESCRIPTION OF THE DRAWINGS

The present invention will now be explained in more detail with a practical example, shown in the drawings, in which.

DETAILED DESCRIPTION OF PREFERRED EMBODIMENTS

Figure 1:
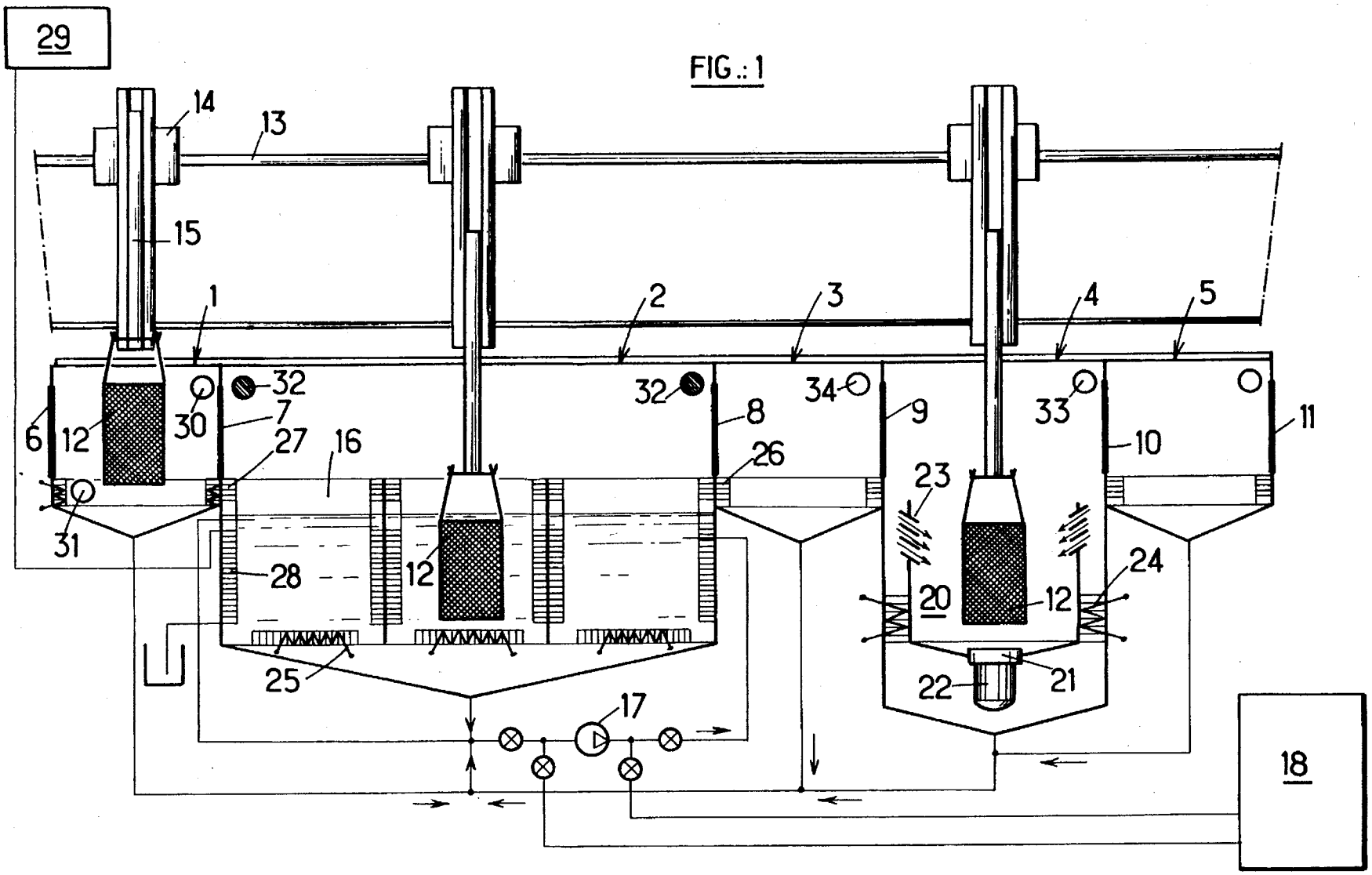
FIG. 1 is a schematic view in longitudinal cross section of an installation for practicing the process of the invention.

The installation described in FIG. 1, which is an installation for cleaning small pieces, is divided in five compartments, which are in the order reached by the pieces to be treated, an entry gas lock 1, a treatment chamber 2, an intermediate gas lock 3, a drying chamber 4 and an outlet gas lock 5. The installation comprises an entry door 6, intermediate doors 7 to 10 separating the different compartments, and an outlet door 11. Baskets 12 which contain the pieces to be treated are supported by a monorail 13, situated outside the installation, and on which roll supports 14 provided with a winch, and from which is suspended a suspension member 15 which carries the basket 12. The suspension member 15 enters the installation through a brush joint, which extends over all the length of the roof of the installation, below the monorail 13.

The arrangement of the monorail outside the installation, and above the roof of the latter is not necessary but is dictated here by the fact that a preexisting installation is used, so as to limit the cost of conversion.

The gas locks 1, 3 and 5 have a bottom which has a lowermost point from which the treatment liquid resulting from condensation can be evacuated. The treatment chamber 2 contains, in its lower portion, a tank 16, formed by three compartments, in which circulates a volatile and inflammable treatment liquid which, according to the conventional technique, moves countercurrent to the objects contained in the baskets 12. This product, in the described example, and without thereby limiting the scope of the invention, is a product "Axarel" 6100, or 9100 (trademark), which is a commercial cleaning solvent from the du Pont de Nemours Company, and which is comprised by a mixture of hydrocarbons and of non ionic surfactants, with respective flash points of 61° C. and 96° C.

A circulation pump 17 ensures the circulation of the treatment product. It can also convey the product to a separate regeneration installation 18. The pump 17 also recovers the condensation product from the gas locks 1, 3, 5 and from the drying chamber 4, as well as the treatment product recovered in the lower portion of the treatment chamber 2, and arising from possible sealing defects of the tanks.

The drying chamber 4 has at its lower portion a double walled upwardly open chamber 20. The bottom of the chamber 20 has a lowermost point which comprises an opening below which is located a refrigeration assembly which comprises a fan 21, disposed to withdraw the gases contained in the chamber 20, and a condenser-refrigerator 22, which lowers the temperature of these gases to a level sufficiently low that substantially all the treatment product vapors which they contain are condensed. The condensate is conveyed by the treatment product circulation pump 17, as indicated above. The cooled and purified gas is blown by the fan 21 to pass through the thickness of the double wall of the chamber 20. It leaves this double wall through a series of nozzles 23 which are directed toward the center of the chamber 20, which is to say toward the products to be dried, when a basket 12 is located in this chamber. Heating elements 24 are disposed in the lower portion of the double wall, in the path of the gases so as to bring them to a higher temperature. It will be understood that the hot gases, substantially stripped of treatment product vapors, and projected at a high velocity onto the products to be dried, ensure a very rapid drying of these latter.

The control of the temperatures in the installation is an important point, which is the object of particular attention for safety reasons.

In addition to the heating elements 24, there are provided other heating elements 25 in the base of the compartments of the tank 16. Moreover, refrigerators 26, 27, 28 are provided respectively in the lower portion of the gas locks 1 and 3, and above the liquid which is located in the compartments of the tank 16. The function of these refrigerators is to control the treatment product vapor content in the gas locks 1 and 3, and in the upper portion of the chamber 2. The condensates formed in the gas locks 1 and 3 are gathered by the pump 17, the condensates formed on the refrigerators 27 of the treatment chamber 2 falling directly into the tank 16.

Moreover, the high capacity refrigerators 28 are immersed in the compartments of the tank 16. The function of these refrigerators 28 is different from that of refrigerators 27 located above: in the case of damage to the installation, with the risk of entry of air into the chamber 2, it would be necessary to cool very rapidly all the contents of the tank 16 to a temperature sufficiently low that all danger of fire is avoided. To do this, it is provided that the refrigerators 28 are connected to a reserve 29 of refrigerating fluid, which can simply be cold water, preferably maintained at a level higher than that of the installation, such that the liquid can flow by gravity into the refrigerators 28, even in the case of power failure.

It is clear that the composition of the atmosphere in the various portions of the installation is an essential element for the practice of the invention.

There will now be described these latter, particularly with regard to FIGS. 2–4.

Figure 2:
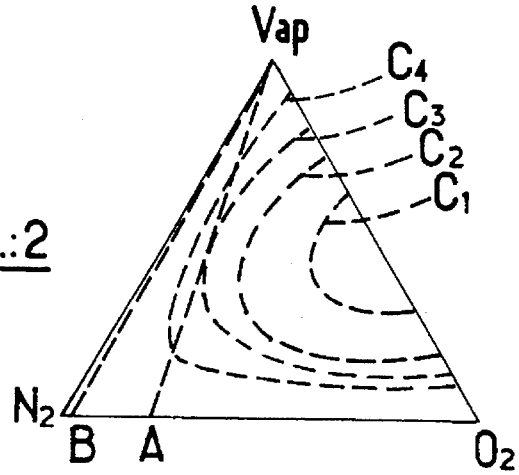
FIG. 2 is a schematic three component diagram of the mixture nitrogen-oxygen-treatment product vapors.

FIG. 2 is a three-component nitrogen-oxygen-vapor diagram. The point A represents the normal composition of air. The point B represents the composition of the nitrogen used, containing a little oxygen. For reasons of clarity, the point B has been positioned so as to indicate a relatively high percentage of air. Of course a purer nitrogen can be used.

The curves C1, C2, C3, C4 correspond to the limits of flammability of the nitrogen-oxygen-vapor mixture for different temperatures. These curves correspond to increasing temperatures, for example the curve C1 corresponds to the temperature of the refrigerators 27, the curve C3 to the temperature of the treatment liquid in the tank 16, the curve C2 to the intermediate temperature, for example that which prevails in the gas lock 1, and the curve C4 to the drying temperature.

In the inlet gas lock 1, the atmosphere should be adapted to be renewed fairly rapidly after opening the doors 6 and 7, to let pass a basket 12. To do this, it is possible to introduce nitrogen by blowing outlets 30, connected to a source of nitrogen, which can be a "Floxel" (trademark) installation for the production of nitrogen, which is to say the nitrogen can contain up to 1% or 5% oxygen, as the case may be. The nitrogen introduced by the outlets 30 is withdrawn through other outlets 31, the nitrogen flow is fixed as a function of the dwell time of a basket 12 in the gas lock.

Figure 3:
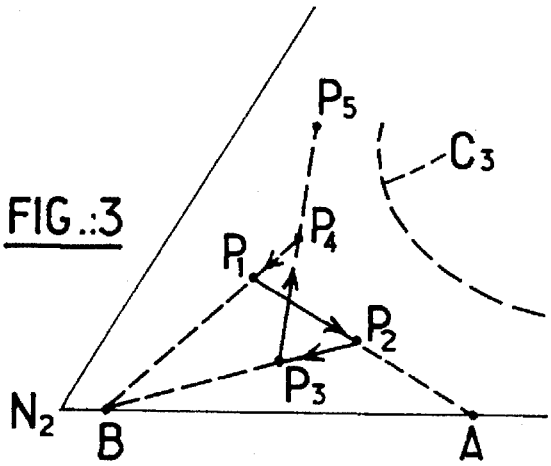
FIGS. 3 and 4 are enlarged views of the diagram of FIG. 2, showing approximately the variations in composition of the atmosphere in certain of the compartments of the installation.

FIG. 3 shows in more detail the variations of the composition of the mean atmosphere in the gas lock 1. From a composition represented by the point P1, the opening of the inlet door 6 gives rise to the entry of air, and brings the composition to point P2, located on a straight line joining point P1 to point A which represents the composition of air. The closure of the door and the introduction of nitrogen displaces the point representative of the composition of the atmosphere to point P3, on a straight line connecting the point P2 to point B which represents the composition of nitrogen. Opening the door 7 for communication of the inlet gas lock 1 with the treatment chamber 2, introduces into the gas lock a certain quantity of atmosphere having the composition represented by the point P5, which is to say substantially richer in vapors. The representative point then becomes P4, on the straight line joining the point P3 to point P5. A new influx of nitrogen brings the composition to the point P1, which is located on the straight line joining the point P4 to point B. The changes in the atmosphere of the gas lock are always quite distant from the curve C3 corresponding to the limit of inflammability, and thus even further from the curve C2 which corresponds to the temperature prevailing in the gas lock thanks to the presence of the refrigerator 26.

In the chamber 2, the situation is different. The continuous presence of treatment liquid at a relatively high temperature in the tank 16 creates, adjacent to the surface of this liquid, a zone in which the concentration of vapors is high. Thanks to the presence of the refrigerators 27, this concentration decreases substantially in a direction vertically away from the liquid. It decreases in an even more marked fashion to the extent the atmosphere above the tank is stationary. For this purpose, there is introduced only a small quantity of nitrogen into the chamber 2, the insufflation taking place through porous plugs 32, located in the upper portion of the compartment, and disposed so as to introduce the hydrogen without making eddies. The porous plugs can be replaced by porous injection devices of suitable shape. The quantity of nitrogen to be introduced is small, and serves only to compensate the losses resulting from the presence of the joint in the roof and the openings of doors 7 and 8.

There is thus obtained a "laminar" atmosphere.

Figure 4:
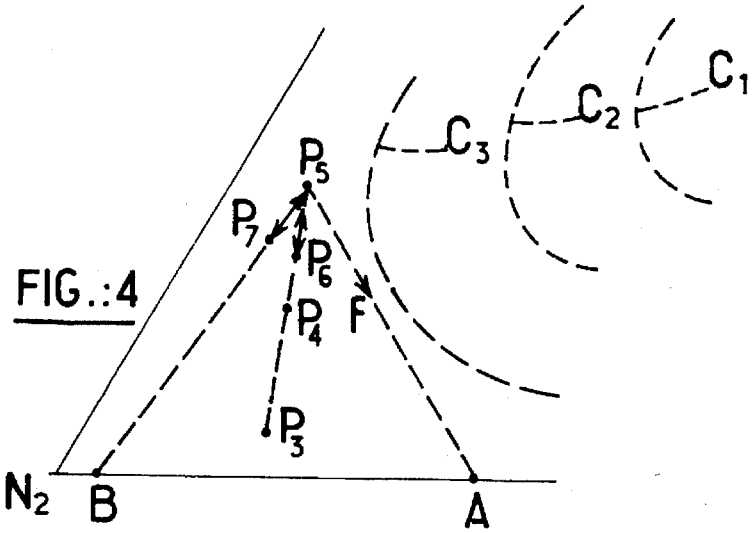

FIG. 4 shows the situation in the treatment chamber 2. The point P5 represents the mean composition of the atmosphere in this chamber, it being understood as pointed out above that this chamber has substantial variations between its upper and lower portions. The opening of the door 7 communicating with the gas lock 1 introduces into the treatment chamber a certain quantity of gas having the composition of the point P3 of FIG. 3, and the mean atmosphere of the treatment chamber 2 will then be represented by the point P6. Under the influence of the vaporization of the treatment liquid, and of the introduction of nitrogen, it then returns to point P5. The opening of the door 8, for communication with the gas lock 3, in which the atmosphere is comprised principally of nitrogen, similarly displaces the point representative of the atmosphere to a point P7, located between the point P5 and the point B, the representative point then returns to point P5. It will be noted that, in any event, the composition of the atmosphere remains displaced from the combustion curve C3. Let it be supposed on the other hand that by a serious accident, a mass of air is introduced into the treatment chamber. The composition of the atmosphere will change according to the arrow F, in the direction of point A. It therefore carries the danger of passing adjacent the combustion curve C3. It is for this reason that it is necessary to cool quickly the contents of the tank 1, such that the inflammability limit will no longer be defined by the curve C3, but by the curve C2 or the curve C1.

In the drying chamber 4, in contrast to the treatment chamber 2, the atmosphere is highly agitated by the gas leaving the nozzles 23, but this is an atmosphere with a very low content of treatment product vapors. It is therefore not necessary to introduce into it large quantities of nitrogen. The quantity of nitrogen introduced by the outlets 33 serves solely to compensate the losses.

The point representative of the composition of the atmosphere in the drying chamber 4, and more particularly in the upper part of this latter, is therefore always adjacent to the point B of FIGS. 2–4.

The intermediate gas lock 3 is disposed between two chambers in which the normal oxygen content is low. In the treatment chamber 2, the atmosphere is charged with treatment product vapors, see point B5 of FIG. 4, and the atmosphere is laminar. In drying chamber 4, the atmosphere, particularly above the chamber, is composed essentially of nitrogen, and corresponds to point B on FIG. 4. The opening of the communication doors 8 and 9 of the intermediate gas lock to one or the other of these two chambers has the effect of displacing the point representative of its atmosphere between the points B and P5 of the figures, while still staying away from the combustion curves. The blowing mouths 34 provided in the intermediate gas lock 3, therefore have a low flow rate, except in the case of damage. To obtain an even more calm condition of the atmosphere before opening the door 8, it may be advantageous to provide also that this blowing mouth is provided with a porous plug. The refrigerator 27 contained in the intermediate gas lock serves to reduce the treatment product vapor content of the gas which would if desired be introduced into the drying chamber. An excessive introduction of vapors into this chamber could have the result of diminishing the efficiency of the refrigerator 22, and therefore the efficiency of drying.

The outlet gas lock 5 is not essential for safety, because it separates the drying chamber 4, and hence the atmosphere containing practically no combustible vapors, from the ambient air. It however serves to prevent the pollution of the ambient air, by eliminating the low content of vapors which otherwise would escape to the outside. Moreover, it prevents an abrupt reentry of air into the drying chamber. This air, drawn in by the fan 21, is brought to a high temperature by the heating elements 24, and could ignite the rest of the treatment products retained on the products to be completely dried, and damage these products. It is therefore preferable that a relatively large flow of nitrogen be sent into the outlet gas lock 5.

For the sake of simplicity, there have not been shown the sensors which permit supervising the installation. These latter comprise sensors indicating the temperature of the atmosphere in each of the chambers or gas locks, as well as the temperature of the gas blown toward the objects to be dried in the drying chamber, and sensors sensitive to the temperature of the treatment liquid in the tank. The heat exchange liquid sent to the various refrigerators is itself monitored. Oxygen sensors permit continuously monitoring the oxygen content in the atmosphere of each of the chambers or gas locks of the installation. In a conventional fashion, there are also provided detectors for the closing of the various doors.

In FIG. 1, there have been shown the paths of movement of the treatment product as located outside the installation. In fact, for safety reasons, the whole of this circuit is disposed within the chamber, and as a result is located in a protected atmosphere. If a portion of the path leaves the chamber, it is preceded by a refrigerator, such that the liquid which is outside the chamber will be at a safe temperature.

What is claimed is:

1. A process for the treating an object with an inflammable volatile treatment liquid and removing said liquid, comprising: providing an installation comprising a closed chamber having an inlet provided with a first air lock and an outlet provided with a second air lock, and a transport system disposed above said closed chamber, said closed chamber containing at least one upwardly open tank filled with said liquid, a drying device for removing said treatment liquid from the treated objects, and an atmosphere comprised principally of an oxygen-impoverished gas, said process also comprising: transporting with said transport system an object to be treated above the tank, immersing said object in the tank, withdrawing said object from the tank, transferring said object to the drying device, and removing said object from said drying device, said process further comprising treating said object in said drying device with preheated oxygen-impoverished gas, at a temperature higher than that at which the vapors of the treatment liquid would otherwise burn in the presence of ambient air, and maintaining an oxygen content of said atmosphere sufficiently low that ignition of said vapors will not occur during said process, by introducing additional oxygen-impoverished gas into said chamber by passing through porous plugs so as to substantially prevent agitation of said atmosphere.

2. Process according to claim 1, further comprising generating said preheated oxygen-impoverished gas by condensing vapors of said treatment liquid from said gas in said drying device, and then preheating the resulting noncondensed gas having treatment vapors removed therefrom.

3. Process according to claim 1, further comprising continuously monitoring the oxygen content of the atmosphere in said chamber, and adjusting said content by introducing said additional oxygen-impoverished gas when said monitoring detects an oxygen content above a predetermined level, and continuously maintaining the temperature of the treatment liquid in the tank at a predetermined level.

4. Process according to claim 1, further comprising passing said object through a third gas lock which is disposed within said closed chamber, said third gas lock separating said chamber into a first part containing said tank and a second part containing said drying device.

* * * * *